US009643226B2

(12) United States Patent
Thompson et al.

(10) Patent No.: US 9,643,226 B2
(45) Date of Patent: May 9, 2017

(54) FLEXIBLE PIPE CARCASS FORMING APPARATUS

(71) Applicant: BARTELL MACHINERY SYSTEMS LLC, Rome, NY (US)

(72) Inventors: Walter F. Thompson, Lindsay (CA); Jerry L. Eisenhart, Shavertown, PA (US); K. Brian Turvey, Clinton, NY (US)

(73) Assignee: Bartell Machinery Systems, L.L.C., Rome, NY (US)

( * ) Notice: Subject to any disclaimer, the term of this patent is extended or adjusted under 35 U.S.C. 154(b) by 76 days.

(21) Appl. No.: 14/349,743

(22) PCT Filed: Oct. 8, 2012

(86) PCT No.: PCT/US2012/059199

§ 371 (c)(1),
(2) Date: Apr. 4, 2014

(87) PCT Pub. No.: WO2013/055618

PCT Pub. Date: Apr. 18, 2013

(65) Prior Publication Data

US 2014/0238094 A1 Aug. 28, 2014

Related U.S. Application Data

(60) Provisional application No. 61/546,055, filed on Oct. 11, 2011, provisional application No. 61/554,639, filed on Nov. 2, 2011.

(51) Int. Cl.
*B21C 37/12* (2006.01)
*B21C 37/08* (2006.01)
(Continued)

(52) U.S. Cl.
CPC ..... *B21C 37/121* (2013.01); *B21C 37/126* (2013.01); *B65H 19/22* (2013.01)

(58) Field of Classification Search
CPC ... B21C 37/0807; B21C 37/083; B21C 37/12; B21C 37/121; B21C 37/122;
(Continued)

(56) References Cited

U.S. PATENT DOCUMENTS 1,741,812 A 12/1929 Edson
1,747,112 A * 2/1930 Good ..... 426/134
(Continued)

FOREIGN PATENT DOCUMENTS

EP 0148061 7/1985
GB 1310877 3/1973
(Continued)

OTHER PUBLICATIONS

International Preliminary Report on Patentability for PCT/US2012/059199 dated Apr. 24, 2014, 2 pgs.
(Continued)

*Primary Examiner* — Edward Tolan
(74) *Attorney, Agent, or Firm* — Brinks Gilson & Lione

(57) ABSTRACT

An apparatus for forming a carcass for encasing a tubular member including a driven rotor (20) having a front face rotatable about a pivot axis and a spool mandrel (38) positioned eccentrically on the driven rotor (20). The spool mandrel (38) is adapted to rotatably mount a roll of coiled strip material (32). The rotor (20) includes at least one counterweight (60) mounted on the front face that is dynamically movable to at least partially balance the changing weight of the roll of strip material as the strip material (32) is removed from the roll. At least one pusher roll assembly (75) is mounted on the front face and contacts a portion of the strip material (32) to partially deform the
(Continued)

coiling of the strip material as the material is removed from the roll. An anti-kink roll assembly (90) prevents kink deformation of the strip material (32) during the formation of the carcass.

17 Claims, 4 Drawing Sheets

(51) Int. Cl.
*B21C 37/083* (2006.01)
*B65H 19/22* (2006.01)

(58) Field of Classification Search
CPC ... B21C 37/124; B21C 37/126; B21C 37/127; B21C 37/128; B65H 19/22; B65H 19/2207; B65H 19/2292
USPC ..... 72/49, 50, 368; 228/145
See application file for complete search history.

(56) References Cited

U.S. PATENT DOCUMENTS 2,923,487 A * 2/1960 Wands ..... B65H 19/2238 242/533.5
3,858,421 A 1/1975 Wood
4,597,276 A * 7/1986 Legallais et al. ..... 72/49
4,628,675 A * 12/1986 Sakamoto ..... H01B 13/0841 57/13
4,783,980 A 11/1988 Varga
4,895,011 A 1/1990 Varga
5,263,309 A 11/1993 Campbell et al.
5,487,261 A * 1/1996 Varga ..... G02B 6/4491 57/11
5,593,101 A 1/1997 Varga

FOREIGN PATENT DOCUMENTS

GB 1310877 A * 3/1973
WO WO95/20698 8/1995
WO WO2012/135922 10/2012

OTHER PUBLICATIONS

Written Opinion for PCT/US2012/059199 dated Apr. 24, 2014, 10 pgs.
International Search Report for PCT/US2012/059199 dated Jan. 8, 2013, 7 pgs.
Chinese Office Action for Chinese Patent Application No. 2015-032701098580 issued Apr. 1, 2015, 9 pgs.

* cited by examiner

FLEXIBLE PIPE CARCASS FORMING APPARATUS

RELATED APPLICATIONS

The present patent document is a §371 filing based on PCT Application Serial No. PCT/US2012/059199, filed Oct. 8, 2012 (and published as WO 2013/055618A1 on Apr. 18, 2013), designating the United States and published in English, which claims the benefit of the filing date under 35 U.S.C. §119(e) of Provisional U.S. Patent Application Ser. No. 61/554,639, filed Nov. 2, 2011, and further claims the benefit of the filing date under 35 U.S.C. §119(e) of Provisional U.S. Patent Application Ser. No. 61/546,055, filed Oct. 11, 2011. All of the foregoing applications are hereby incorporated by reference in their entirety.

BACKGROUND

The present invention generally relates to machines for forming materials and armor structures to protect tubular members. More particularly, the present application relates to a carcass-forming machine for encasing a tubular member.

Carcass machines produce a carcass of a flexible pipe. A main purpose of the carcass is to prevent the pipe from collapsing under external pressure, e.g., due to water pressure and mechanical crushing during production and installation of the pipe. The collapse strength generally depends on the mechanical integrity of the metal carcass which should withstand the force of the external pressure.

Carcass machines may produce the armor carcass by the process of roll forming and winding of sheet metal strips. For example, a carcass machine may cold-form a flat steel (or other material) strip into an interlocking structure.

Typically, a flat strip of material such as steel is pulled off of a coil and is run through a series of deforming operations to form a profile of the interlocking structure. These operations are performed by pressers or rollers that gradually change the profile of the strip, and subsequent to the generation of such a strip, a winding step is used during the manufacture of the carcass for the flexible pipe body. In some examples, the carcass strip is formed into a profile having hook and valley regions, so that as the strip of material is wound, adjacent windings are interlocked together by nesting hook and valley regions. During manufacture, the shaped strip may be wound at an angle, so that the flexibility of the metal carcass produced allows the metal carcass sufficient flexibility.

Machines that are typically used to form the carcass structures are large, and they require that the metal strip is fed off of a stationary spool or coil. For especially large carcass structures, such as those used to armor wide-diameter tubular structures such as those used in ultra-deepwater oil pumping operations, much wider and heavier metal strip material is required to be used. Because the more substantial metal strip material is extremely rigid and heavy, it may be impractical to mount the coil of strip material and thread it toward a moving rotor for profile formation.

SUMMARY

In one aspect of the present invention, an apparatus for forming a carcass for encasing a tubular member includes a driven rotor having a front face rotatable about a pivot axis and a spool mandrel positioned eccentrically on the driven rotor. The spool mandrel is adapted to rotatably mount a roll of coiled strip material. The rotor includes at least one counterweight mounted on the front face that is dynamically movable to at least partially balance the changing weight of the roll of strip material as the strip material is removed from the roll. At least one pusher roll assembly is mounted on the front face and contacts a portion of the strip material to partially deform the coiling of the strip material as the material is removed from the roll.

In another aspect of the invention, an anti-kink roll assembly is mounted to the front face for preventing kink deformation of the strip material during the formation of the carcass.

In yet another aspect of the invention, at least one clamping assembly is mounted to the strip material to control the uncoiling of the strip material from the roll and to prevent unthreading of the machine.

In a further aspect of the invention, a roll of coiled strip material is removably and rotatably mounted to the spool mandrel. The roll of material may be interchanged with other rolls on the rotor.

In yet another aspect of the invention, a roller assembly is mounted to the front face for pre-deforming the strip material prior to feeding the strip material into profile-forming roller assemblies.

Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
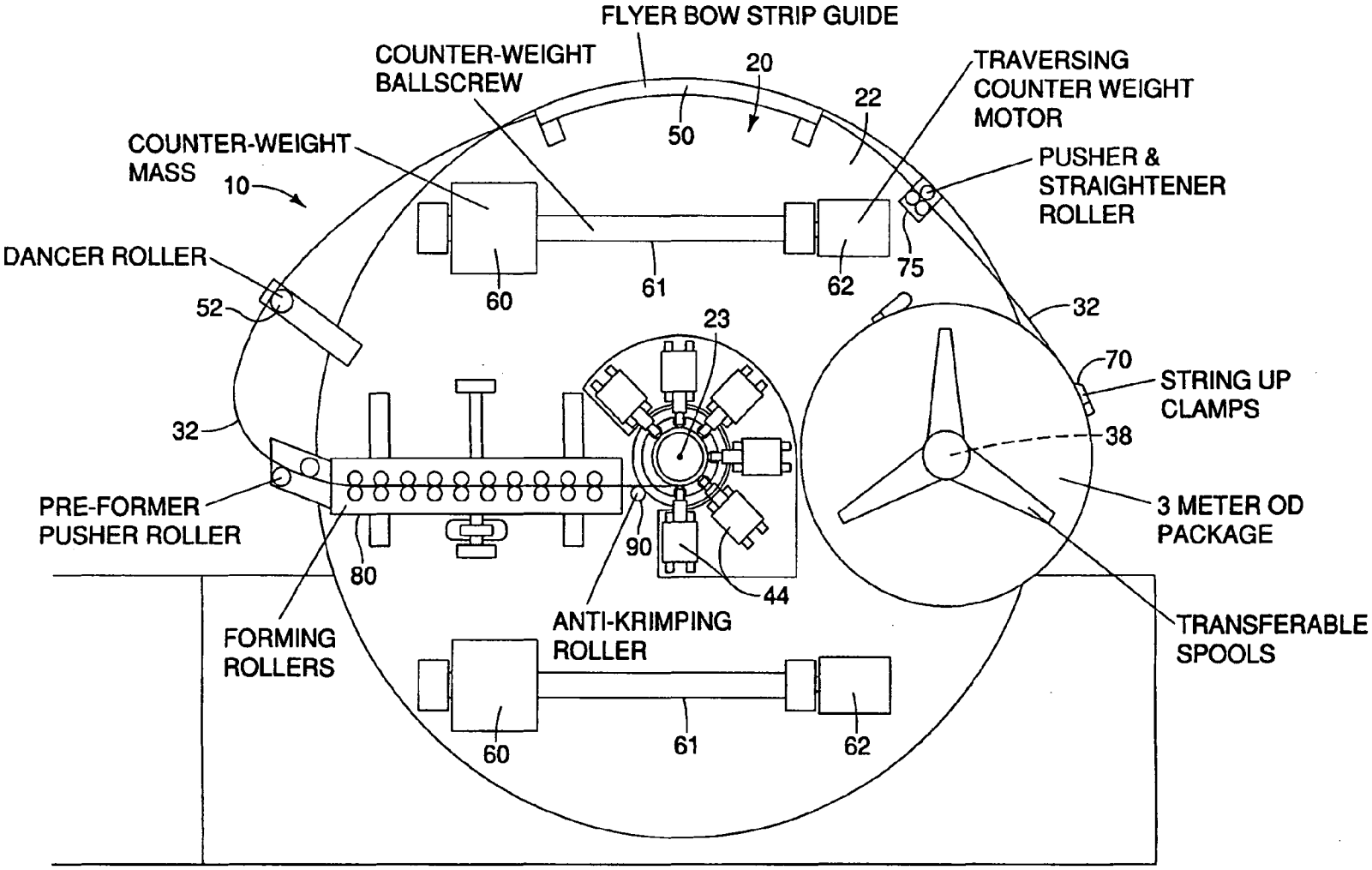
FIG. 1 is a schematic diagram illustrating a frontal view of an embodiment of the apparatus of the present invention.
Figure 2:
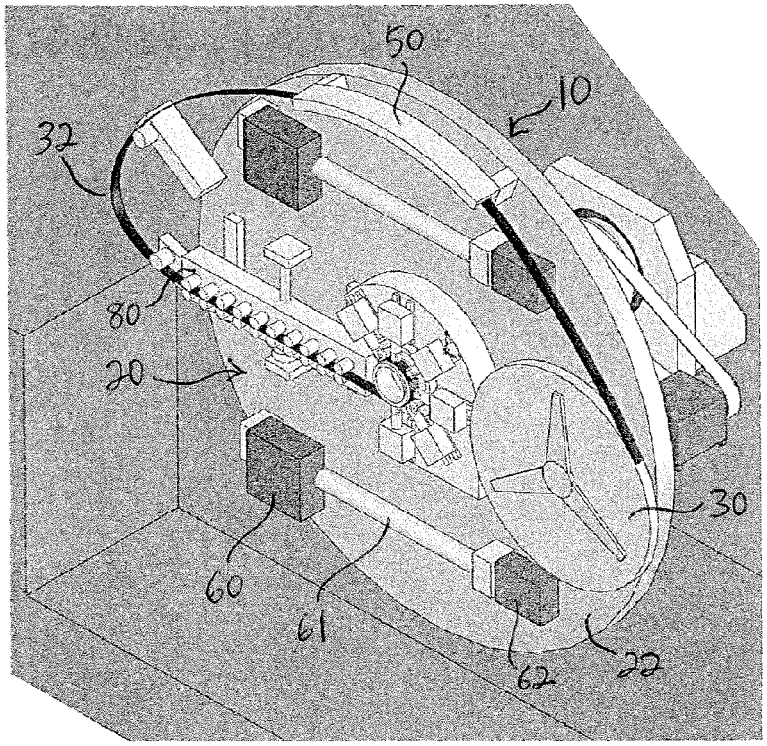
FIG. 2 is a schematic diagram illustrating a perspective view of the apparatus of FIG. 1.
Figure 3:
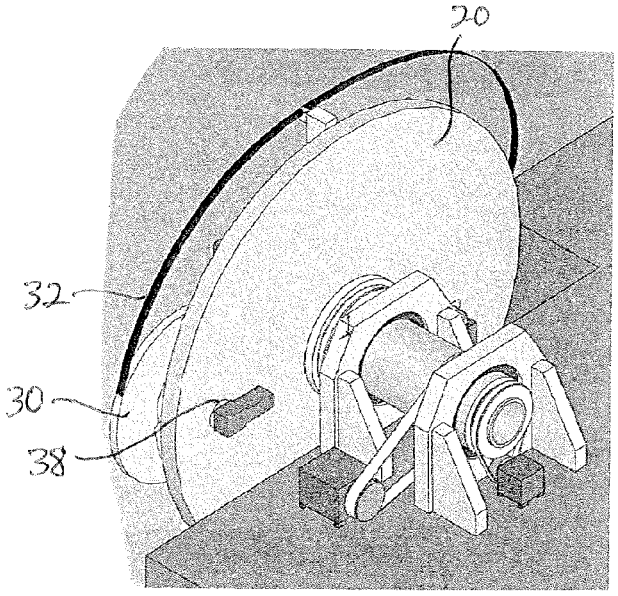
FIG. 3 is a schematic diagram illustrating an additional perspective view of the apparatus of FIG. 1.
Figure 4:
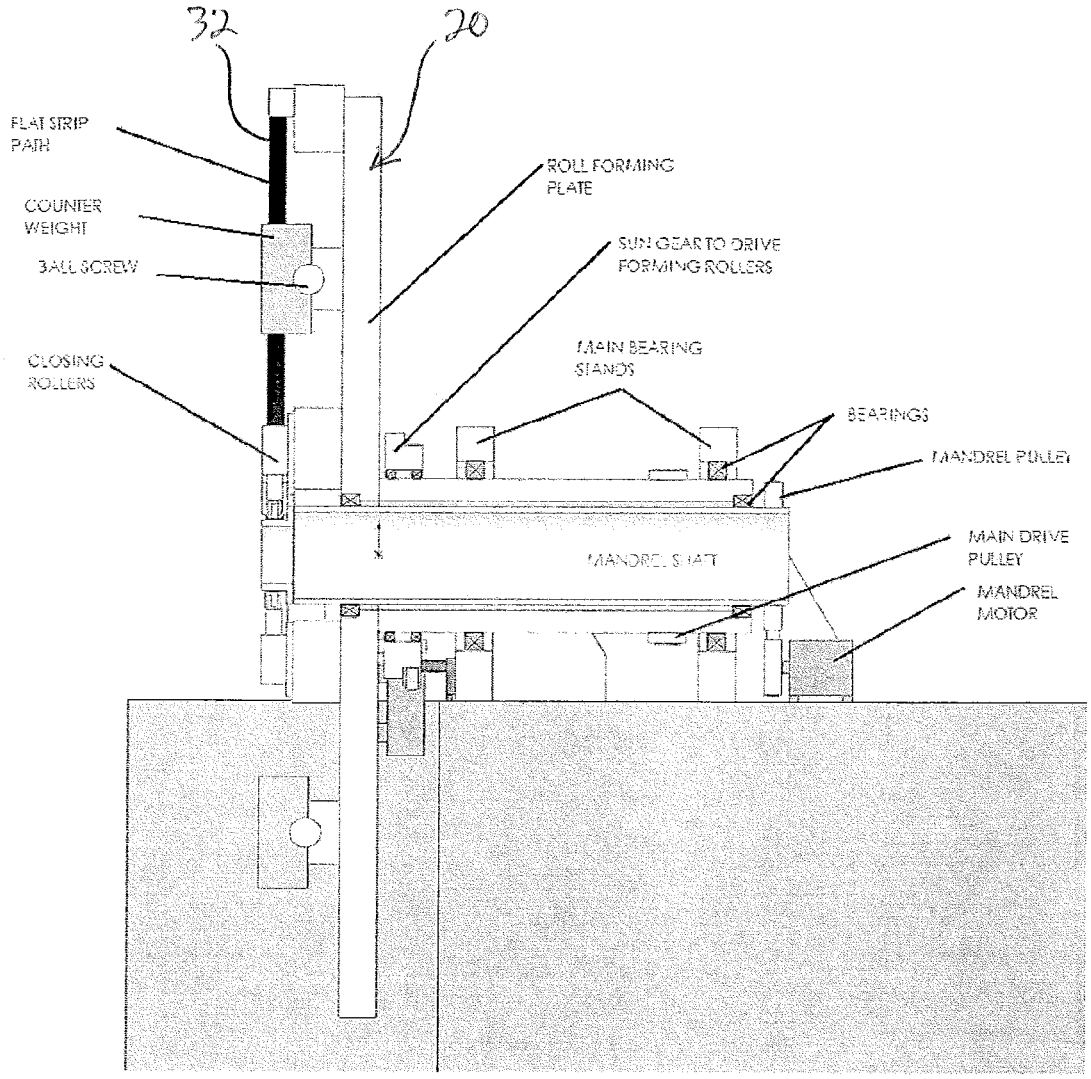
FIG. 4 is a schematic diagram illustrating a side view of the apparatus of FIG. 1.

Turning now to FIGS. 1-5 of the drawings, a carcass-forming machine 10 is shown having a main rotor 20 that is mounted for rotatable movement around an axis 23. Conventional profile-forming tooling is shown at 44 near the axis 23 of the rotor 20 that forms strip material 32 into a generally S-shaped profile for interlocking in a helical and tubular armor structure as may be known in the art.

The rotor 20 includes a spool mandrel 38 that may rotatably and removably receive transferable spools 30 of strip material 32. An example is a coil of strip metal 32 in a 3-meter OD package. The spool mandrel 38 and the spool 30, when mounted, rotate around the axis 23 along with the rotor 20.

The transferable mandrel allows for a complete transfer of coil packs from the rewind line onto the profiling machine front face 22. In normal practice, the coil pack only is lifted from the rewind line and center core is placed onto the front plate chuck. This introduces the ability for the coil to unwind, lose proper tension and pose a great safety risk. A transferable mandrel allows for the pack to be wound safely and efficiently on the rewind line. The chuck shaft, material and side plates will then be removed from the rewinder and accepted onto the machine front face 22. This facilitation would be very similar to machine tools in operation and locking mechanism. With control over the coil pack during this move, the operator will be able to move the entire pack in a more expedient and safe manner. The empty mandrel from the machine then can replace the one taken from the rewinder. A third mandrel will allow for continual transference of empty/full packs with minimal downtime.

In order to balance the extreme eccentric rotary weight of the spool 30 of the strip material 32, one or more counterweight masses 60 are mounted to the front face 22 of the rotor 20. In the present embodiment, two counterweights 60 are shown that move along ballscrew structures 61 along chords of the rotor 20 utilizing traversing motors 62, as shown in FIG. 1. The weights 60 move automatically to correct for the eccentric rotation of the rotor 20 as the weight of the transferable spool 30 is reduced as material is unwound therefrom during the profile-forming process.

If the strip 32 is cut for changeover or any other circumstance, one or more string up clamps 70 would be engaged to prevent any unnecessary movement of the cut ends. A clamp above the coil pack would prevent the strip 32 from backing through the pusher rollers 75 to the pipe. Another clamp near the coil spool would prevent the material from loosening on the coil pack which results in both a safety risk and coil changeover.

To facilitate the deformation of the coiled material into an unwound state and to allow for improved feeding into the apparatus such as the flyer bow strip guide 50, a roller assembly noted as a pusher and straightener roller assembly 75 may be used to unwind the material from the spool 30. A dancer roller 52, as shown in FIG. 1, facilitates feeding into the forming roller apparatus 80. The pusher and straightener assemblies are utilized to help facilitate safe and efficient string up of the machine. A motorized three roller assembly assists in feeding the strip material 32 to the next process step on the tooling plate. The operator would then be allowed to handle a controlled amount of strip 32 as required to thread up the tooling.

Finally, an anti-kink roll assembly 90 is used just before the profile interlocking process near the axis 23 of the apparatus in order to prevent kinking of the profile. During the formation of a fully interlock carcass profile, several progressive steps are taken to achieve the proper dimensions. In some instances, there is a tendency to have a tight bend of the strip 32 which creases rather than forms a full radius. The unsupported strip, due to the imposed forces, may buckle. The primary area for this to occur is during the final folding or interlocking operation when the side of the preformed strip 32 is being rolled from a raised position to a folded down, interlocking position. This tendency may be exacerbated due to the strip 32 being in tension from both the pre-forming of its cross-section plus the longitudinal preforming while being wound around the support mandrel to form the pipe diameter.

Figure 5:
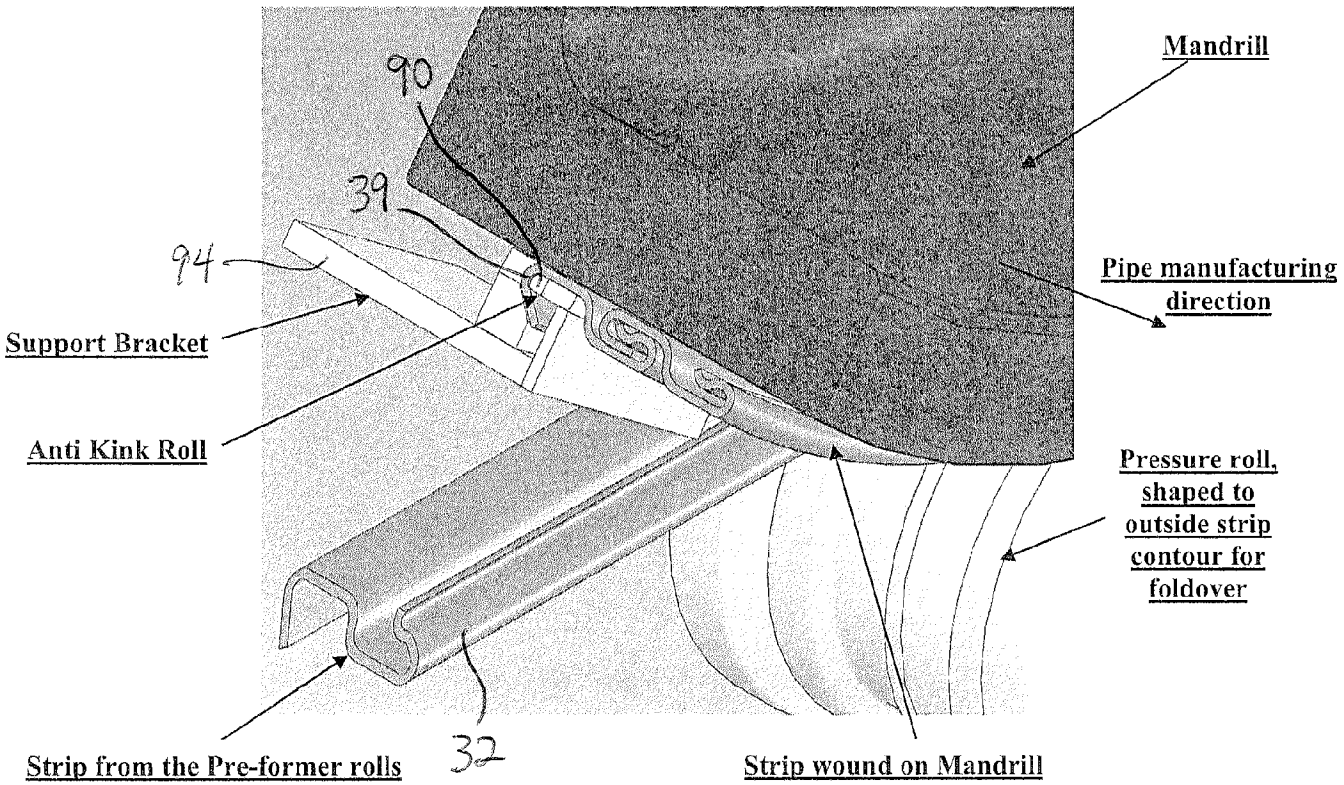
FIG. 5 is a schematic diagram illustrating features of an anti-kink roll assembly of FIG. 1.

To reduce this tendency to buckle or kink during this process step, the anti-kink roller 90 adds shaped support to an inner area of a fold radius, such as the fold radius 39 of FIG. 5, to allow the strip 32 to fully form the desired radius bend or fold over, rather than have a tendency to crease or kink. In the embodiment of FIG. 5, the exemplary anti-kink roller 90 comprises a series of shaped roller bearings, or a bushing, held in position along the strip axis 23 on the mandrel via a bracket arrangement 94. The anti-kink roller 90 is positioned to offer the shaped support to the inner area of the fold radius 39, and in particular, the bracket arrangement 94 is angled to allow the rollers to contact the inner radius 39 of the wound strip 32 prior to the fold over point, as shown in FIG. 5. Therefore, the anti-kink roller 90 advantageously differs from previous techniques for folding strip material that utilize a shaped pressure roll that matches the outside form of the overall fold, but lacks an inner radius support and therefore is subjected to kinking.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. An apparatus for forming a carcass for encasing a tubular member, said apparatus comprising:

a driven rotor having a front face, said driven rotor rotatable about a pivot axis;

a spool mandrel positioned eccentrically on said driven rotor, said spool mandrel adapted to rotatably mount a roll of coiled strip material;

said rotor including at least one counterweight mounted on said front face for movement relative to said pivot axis, said at least one counterweight being dynamically movable to at least partially balance the changing weight of said roll of strip material as said strip material is removed from said roll; and at least one pusher roll assembly mounted on said front face and contacting a portion of said strip material to partially deform the coiling of said strip material as said material is removed from said roll.

2. The apparatus of claim 1 further comprising an anti-kink roll assembly for preventing kink deformation of said strip material during the formation of said carcass.

3. The apparatus of claim 2 wherein said anti-kink roll assembly comprises a series of shaped roller bearings that contact an inner radius of said strip prior to a fold over point.

4. The apparatus of claim 3 wherein said series of shaped roller bearings are positioned along a strip axis via a bracket arrangement.

5. The apparatus of claim 1 further comprising at least one clamping assembly mounted to said strip material to control the uncoiling of said strip material from said roll.

6. The apparatus of claim 1 wherein said roll of coiled strip material is removably and rotatably mounted to said spool mandrel.

7. The apparatus of claim 1 further comprising a roller assembly mounted to said front face for pre-deforming said strip material prior to feeding said strip material into profile-forming roller assemblies, wherein said profile-forming roller assemblies are adapted to form said strip material into an S-shape capable of interlocking with an adjacently formed profile edge.

8. The apparatus of claim 1, wherein the spool mandrel is positioned eccentrically on said front face of said driven rotor.

9. An apparatus for forming a carcass for encasing a tubular member, said apparatus comprising:

a driven rotor having a front face, said driven rotor rotatable about a pivot axis;

a spool mandrel positioned eccentrically on said driven rotor, said spool mandrel adapted to rotatably mount a roll of coiled strip material;

an anti-kink roll assembly for preventing kink deformation of said strip material during the formation of said carcass, wherein said anti-kink roll assembly comprises a series of shaped roller bearings that contact an inner radius of said strip prior to a fold over point; and at least one counterweight mounted on said front face of said rotor for movement relative to said pivot axis, said at least one counterweight being dynamically movable to at least partially balance the changing weight of said roll of strip material as said strip material is removed from said roll.

10. The apparatus of claim 9 further comprising at least one pusher roll assembly mounted on said front face and contacting a portion of said strip material to partially deform the coiling of said strip material as said material is removed from said roll.

11. The apparatus of claim 9 wherein said series of shaped roller bearings are positioned along a strip axis via a bracket arrangement.

12. The apparatus of claim 9 wherein said roll of coiled strip material is removably and rotatably mounted to said spool mandrel.

13. The apparatus of claim 9 further comprising a roller assembly mounted to said front face for pre-deforming said strip material prior to feeding said strip material into profile-forming roller assemblies, wherein said profile-forming roller assemblies are adapted to form said strip material into an S-shape capable of interlocking with an adjacently formed profile edge.

14. A method for forming a carcass for encasing a tubular member, said method comprising:

providing a driven rotor having a front face, said driven rotor rotatable about a pivot axis;

positioning a spool mandrel eccentrically on said driven rotor, said spool mandrel adapted to rotatably mount a roll of coiled strip material;

preventing kink deformation of said strip material during the formation of said carcass using an anti-kink roll assembly, wherein said anti-kink roll assembly comprises a series of shaped roller bearings that contact an inner radius of said strip prior to a fold over point; and mounting at least one counterweight on said front face of said rotor for movement relative to said pivot axis, said at least one counterweight being dynamically movable to at least partially balance the changing weight of said roll of strip material as said strip material is removed from said roll.

15. The method of claim 14 further comprising mounting at least one pusher roll assembly mounted on said front face and contacting a portion of said strip material to partially deform the coiling of said strip material as said material is removed from said roll.

16. The method of claim 14 wherein said roll of coiled strip material is removably and rotatably mounted to said spool mandrel.

17. The method of claim 14 further comprising mounting a roller assembly to said front face for pre-deforming said strip material prior to feeding said strip material into profile-forming roller assemblies, wherein said profile-forming roller assemblies are adapted to form said strip material into an S-shape capable of interlocking with an adjacently formed profile edge.

* * * * *